US011181297B2

(12) United States Patent
Afkhampour

(10) Patent No.: US 11,181,297 B2
(45) Date of Patent: Nov. 23, 2021

(54) VENT ASSEMBLY FOR A VENTILATION SYSTEM

(71) Applicant: Khosrow Anthony Afkhampour, San Diego, CA (US)

(72) Inventor: Khosrow Anthony Afkhampour, San Diego, CA (US)

( * ) Notice: Subject to any disclaimer, the term of this patent is extended or adjusted under 35 U.S.C. 154(b) by 0 days.

(21) Appl. No.: 17/165,172

(22) Filed: Feb. 2, 2021

(65) Prior Publication Data

US 2021/0172645 A1 Jun. 10, 2021

Related U.S. Application Data

(60) Provisional application No. 63/106,906, filed on Oct. 29, 2020.

(51) Int. Cl.
*F24F 13/10* (2006.01)

(52) U.S. Cl.
CPC ..... *F24F 13/10* (2013.01)

(58) Field of Classification Search
CPC ..... F24F 13/08; F24F 13/082; F24F 13/10; F24F 13/12; F24F 13/1406; F24F 13/20
USPC ..... 454/358, 365, 164, 165
See application file for complete search history.

(56) References Cited

U.S. PATENT DOCUMENTS

| | | | | | |
|---|---|---|---|---|---|
| 2,754,748 | A * | 7/1956 | Daggett | F24F 7/00 | 454/359 |
| 5,046,408 | A * | 9/1991 | Eugenio | F24F 13/1426 | 454/359 |
| 5,662,522 | A * | 9/1997 | Waltz | E04D 13/17 | 454/359 |
| 5,921,863 | A * | 7/1999 | Sells | E04D 13/174 | 454/359 |
| 6,293,862 | B1 * | 9/2001 | Jafine | F24F 7/02 | 454/359 |
| 6,443,834 | B1 * | 9/2002 | Berger | F24F 13/06 | 454/353 |
| 6,974,379 | B2 * | 12/2005 | Koessler | F24F 13/08 | 454/184 |
| 8,209,923 | B1 * | 7/2012 | Rich | F23J 13/00 | 52/219 |
| 10,222,088 | B2 * | 3/2019 | Whitehead | F24F 13/10 | |

* cited by examiner

*Primary Examiner* — Kenneth J Hansen
*Assistant Examiner* — Dana K Tighe
(74) *Attorney, Agent, or Firm* — Barry Choobin; Patent 360

(57) ABSTRACT

Disclosed is an air vent assembly for ventilation systems. The disclosed vent assembly regulates the flow of exhaust air sucked by an exhaust fan of the ventilation system. The vent assembly includes a seat, the seat having a passage for air. The seat can be configured in a base that can be installed over a vent or a grille on the vent. The assembly further includes a lid placed on the seat, such as to block the passage of the seat. A cage surrounding the lid, wherein the cage limits the lateral movement of the lid and provides a guided upper movement of the lid. The cage is of a slanted configuration. The lid can be held against the top of the cage in an inclined position, wherein the angle of inclination can be proportional to the slant of the cage.

14 Claims, 6 Drawing Sheets

VENT ASSEMBLY FOR A VENTILATION SYSTEM

FIELD OF INVENTION

The present invention relates to the field of exhaust ventilation systems, and more particularly the present invention relates to an air vent assembly for regulating the flow of exhaust air in a ventilation system and preventing the accumulation of dust and pollutants in the ducts of an air-conditioning system.

BACKGROUND

Nearly all buildings require mechanical ventilation systems to exhaust pollutants generated inside the building, such as moisture and vapors from bathrooms, laundry rooms, cooking, and chemicals from building materials and cleaners. Buildings that are ventilated well are less likely to experience unhealthy odor or moisture/mold issues. Living in damp or moldy environments has been linked to increased risks of breathing problems, such as asthma.

Central exhaust ventilation systems are the most common type of ventilation systems used in mid to high-rise multi-family buildings constructed after the 1960s. The roof-top electrical fans which are incorporated in the exhaust systems are to help remove polluted/exhaust air and are connected to individual vent of apartments via vertical shafts/ducts. Exhaust shafts are mostly constructed of sheet metal ductworks or sheetrock.

There are problems associated with central exhaust systems that can be linked to a) poor design (inadequate fan power), b) poor installation (improper sealing of connection between horizontal pipe and stack), c) mode of operations (not adjusting fan power for variation of temperatures in hot and cold seasons), and d) lack of proper maintenance (loss of suction due to corrosion which is caused by condensation of moist air in the connecting pipes to the main shaft) or combinations of these issues.

Loss of vacuum in the main shaft due to the abovementioned problems results in the return of mixed exhaust air back into the bathrooms and other living spaces, which can be a serious health hazard. The problem is exacerbated by the opening and closing the bathroom door (or other spaces with vent) which acts like an air pump (blower). When the bathroom door is opened, a large volume of air is pushed into the vent which is helpful but the closing of the door creates a vacuum by pushing the same volume of air out of the bathroom, which in turn sucks in the exhaust air (pollutants) back into the room. Furthermore, in the event of a fire in one of the units, the smoke can find its way into other units, via the main stack and connecting pipes, and create a health hazard situation. Nearly all buildings require mechanical ventilation and fans to exhaust pollutants generated inside the building, such as moisture and vapors from bathrooms and laundry rooms, cooking, and chemicals from building materials and cleaners. Buildings that are ventilated well are less likely to experience unhealthy odor or moisture/mold issues. Living in damp or moldy environments has been linked to increased risks of breathing problems, such as asthma.

Thus, a need is therefore recognized for an assembly to regulate the flow of the exhaust air. A need is there for an assembly that prevents the return of exhaust air to a dwelling unit.

SUMMARY OF THE INVENTION

The principal object of the present invention is therefore directed to an air vent assembly for regulating the flow of exhaust air.

It is another object of the present invention that the assembly prevents the return of the exhaust air.

It is still another object of the present invention that the assembly can be retrofitted to an existing vent.

It is an additional object of the present invention that the assembly can be installed as an add-on to a conventional ventilation system.

It is a further object of the present invention that the assembly is economical to manufacture.

It is yet another object of the present invention that the assembly can be installed in an HVAC system.

It is still a further object of the present invention that the assembly can prevent the intake of polluted air into the ducts of HVAC resulting in deposit of pollutants or insects there and potentially flow back to a dwelling unit when the system used.

It is an additional object of the present invention that the assembly prevents the mixing of air between two dwelling units.

It is still additional object of the present invention that the assembly minimizes the accumulation of dust in duct or pipe of HVAC system.

These and other objects and advantages of the embodiments herein will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe specific embodiments only and is not intended to be limiting of embodiments of the invention. As used herein, the singular forms "a", "an" and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Figure 1:
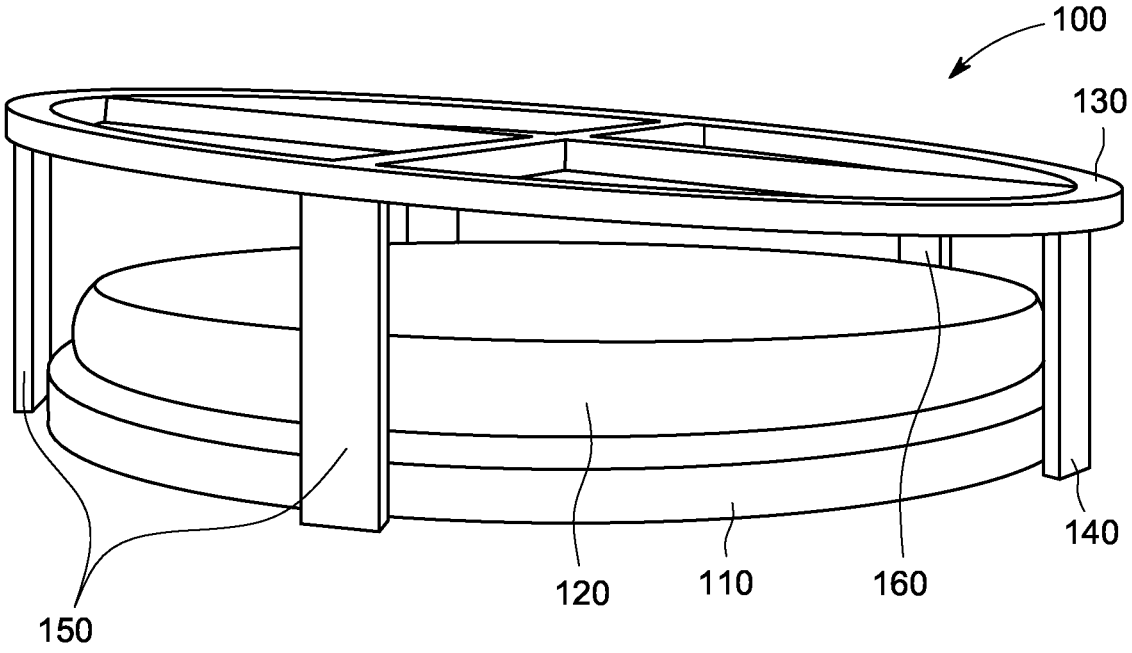
FIG. 1 is a perspective view of the air vent assembly, according to an exemplary embodiment of the present invention.

Referring to FIG. 1, which shows an exemplary embodiment of the disclosed air vent assembly 100. The air vent assembly 100 can install over an exhaust air vent in a dwelling unit. The air vent assembly 100 can be preferably suited for new installation but can also be retrofitted to a vent cover. For installation, the vent cover with built-in disclosed air vent assembly 100 can be provided. The air vent assembly 100 shown in FIG. 1 can be used for horizontal vent installations in the ceiling. A general ventilation system typically draws polluted air from the dwelling unit. The ventilation system typically uses a fan to suck polluted air from a dwelling unit. The dwelling unit can have at least one vent and a duct installed over the vent. The fan can be on the other end of the duct, such as the fan can suck air through the duct. A fan can also be installed in a common duct, wherein multiple ducts branch from the common duct. These multiple ducts can connect to the vents of multiple dwelling units in a building.

The ventilation system can also be a part of an HVAC system. The exhaust air vents can be there in the wall (vertical application) or ceiling (horizontal application) of a dwelling unit. Generally, the exhaust air vents have grills at their entrance. The disclosed air vent assembly 100 can be installed over the grille to control the flow of air through it. Alternatively, the disclosed air vent assembly 100 can be installed over the vent as well. Additionally, a vent cover having the disclosed air vent assembly 100 can also be provided.

The air vent assembly 100 includes seat 110 that can be, in a sealed manner, installed in an exhaust air vent of a dwelling unit. The dwelling unit can be a room, bathroom, and like dwelling units. Additionally, the dwelling unit can also be a construction unit or a production unit. Each dwelling unit can include one or more vents, each vent connected to a pipe or a duct. Seat 110 can a part of a base that corresponds to the shape and dimension of the vent. The base can itself cover the vent, replacing the need for a vent cover, such as a grill. Alternatively, the base can fit over the existing vent cover or grille. Still, in an alternate embodiment, the base can have one or more apertures and one or more seats are configured around the one or more of these apertures. Preferably, the seat and the base can be aesthetic in appearance. Both can be manufactured in a range of designs. The seat includes a passage for the air to flow through. The disclosed assembly 100 also includes a lid 120 rested over the seat 110. The lid 120 is separate from seat 110 and can move vertically or laterally relative to the seat. Both the seat and the lid can be made of materials, such as the lid rested over the seat forms an airtight seal. For example, the lid can be made of lightweight metal, such as aluminum, while the seat can be made of soft rubber that forms an airtight seal with the lid.

The movement of lid 120 can be limited by a cage 130 installed over the lid. The cage 130 shown in FIG. 1 includes five upstanding legs 140, 150, and 160 around the seat 110. The lengths of the five legs are not the same, but two adjacent legs 150 are of a higher length than the opposite leg 160. This gives the top of the cage a sloped configuration. In one case, leg 160 is of a height ¾ inches and legs 150 are 2 inches in height. The cage 130 restricts the lateral movement of the lid 120 and provides limited upward movement. The lid on moving upward, is inclined relative to the slant of the top of the cage. The cage guides the upward movement of the lid, wherein the cage is having a proximal end and a distal end. The cage ascends from the proximal to the distal end, i.e., the proximal end of the cage is having a lower height compared to the distal end.

Figure 2A:
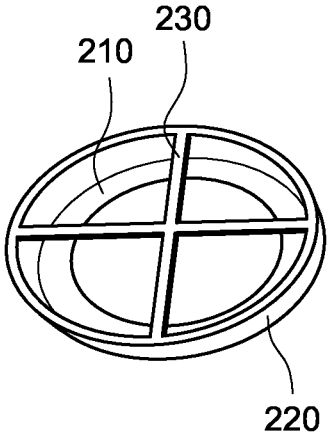
FIG. 2A shows an exemplary embodiment of a cage of the air vent assembly, according to the present invention.
Figure 2B:
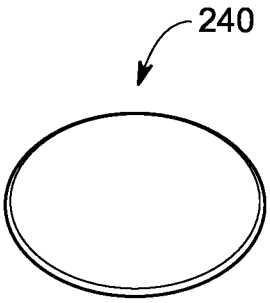
FIG. 2B shows a lid of the air vent assembly, according to an exemplary embodiment of the present invention.
Figure 2C:
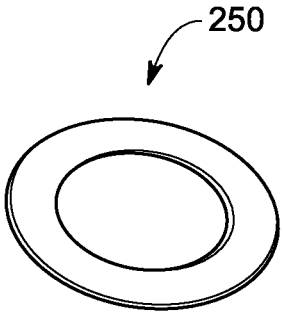
FIG. 2C shows a seat or gasket of the air vent assembly, according to an exemplary embodiment of the present invention.

A ventilation system sucks air from a dwelling unit. The upward thrust produced by the fan of the ventilation system causes the lid 120 to lift upward from seat 110. The proximal end of cage 130 provides limited movement of the lid while the lid can be lifted upwards in an inclined configuration at the distal end of the cage. The polluted/exhaust air in the dwelling unit is sucked through the passage of seat 110. The inclined lid, held against the top of the cage by the force of the air, provides a nearly unidirectional flow of polluted air. Moreover, the inclined lid 120 checks any turbulence of air flowing through the disclosed assembly. The slated cage also prevents the lid from getting stuck in the cage when air is drawn by the fans. Any decrease in pressure in the dwelling unit results in a fall of the lid over the seat producing an airtight seal. This prevents the return of exhaust air from the duct or pipe into the dwelling unit. For example, a sudden vacuum created by the closing of a door of a bathroom will close the passage of the disclosed assembly, thus preventing the intake of exhaust air into the bathroom. The lid can preferably be light in weight that can be easily lifted. Moreover, when the ventilation system is not working, the lid rests on the seat preventing any intake of air, particulate matter, or any pollutants from the duct. Additionally, the disclosed assembly can include a fastener that can lock the lid over the seat Referring to FIGS. 2A, 2B, and 2C which shows an alternate embodiment of the disclosed air vent assembly. FIG. 2A shows an exemplary embodiment of cage 200 of the disclosed air vent assembly. The cage having a circular flange 210 and an upward wall 220 forming a hollow cylinder that extending from the outer periphery of the flange 210. A pair of cross-splines 230 attached to the periphery of the upward wall. The flange 210 of the cage can be planar while the top formed by the cross splines 230 is slanted relative to the planar flange 210. An embodiment of seat 250 is shown in FIG. 2C of a circular configuration. The dimension of seat 250 can be commensurate with the dimension of the flange. Seat 250 can mount over the flange, wherein the seat attaches to the flange or freely rest on the flange. The seat has a passage/aperture at its center for the air. FIG. 2B shows an exemplary embodiment of the lid 340 of a size commensurate with the size of the seat (may be slightly smaller.) The lid can be placed over the seat, wherein the seat is coupled with the flange. The lid can move upwards in the cage while the lateral movement of the lid is limited by the cage. The lid can move upwards up to the cross-splines 230, wherein the lid is held against the cross-spines in the slanted configuration.

Figure 3:
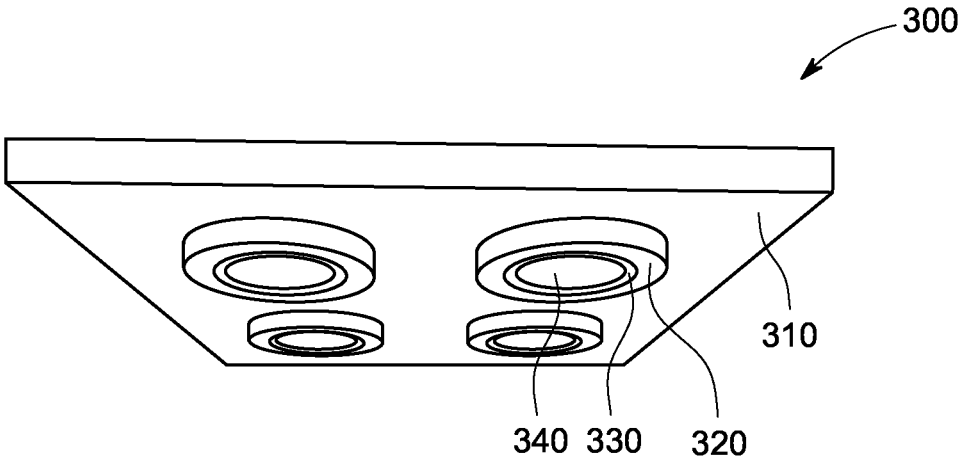
FIG. 3 shows the air vent assembly shown in FIGS. 2A, 2B and 2C installed in a vent cover, according to the present invention.

FIG. 3 shows an exemplary embodiment of the disclosed air vent assembly. FIG. 3 shows a vent cover 300 having a base 310 with four air vent assemblies. The vent cover 300 can be installed at a vent in a dwelling unit for covering the vent. The vent cover 300 can also be removably attached to a frame of an already installed grille. The vent cover 300 can be removed allowing the air vent assembly to be cleaned. For example, the vent cover 300 can be attached with magnets, clips, or Velcro. The four air vent assemblies shown in FIG. 3 can be the same as the air vent assembly shown in FIGS. 2A, 2*b,* and 2C i.e., having the cage 320, the seat 330, and the lid 340 of the air vent assembly. Four apertures can be made in the base 310 and a bottom portion of the cage 320 can be inserted into the apertures. This allows the disclosed air vent assembly to easily retrofit into an existing vent cover or a new vent cover with the air vent assemblies can be provided for new installations. The disclosed vent cover 300 can be suitable for horizontal vent applications.

Figures 4A, 4B, 4C:
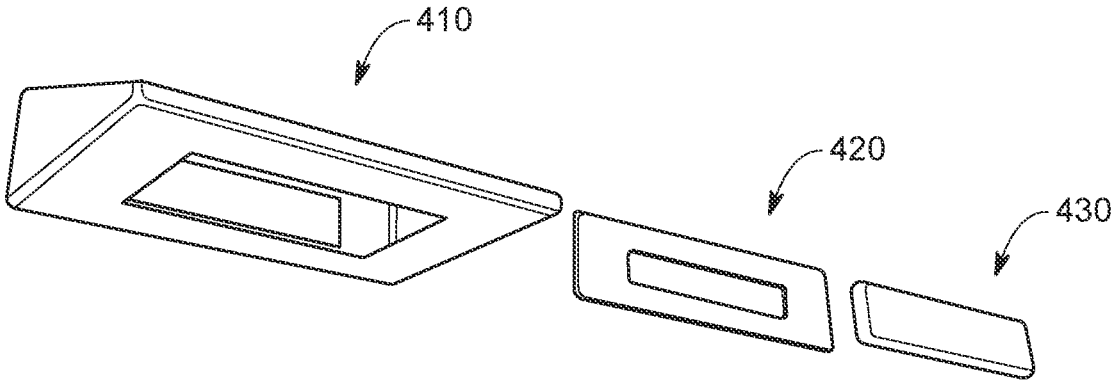
FIG. 4A shows another embodiment of the cage, according to the present invention.
FIG. 4B shows another embodiment of the seat, according to the present invention.
FIG. 4C shows another embodiment of the lid, according to the present invention.

FIG. 4A shows another exemplary embodiment of a slanted cage 410 of the air vent assembly. FIG. 4B shows a seat 420 dimensioned to fit into the cage 410. FIG. 4C shows a lid 430 that can be placed over the seat 420.

Figure 5A:
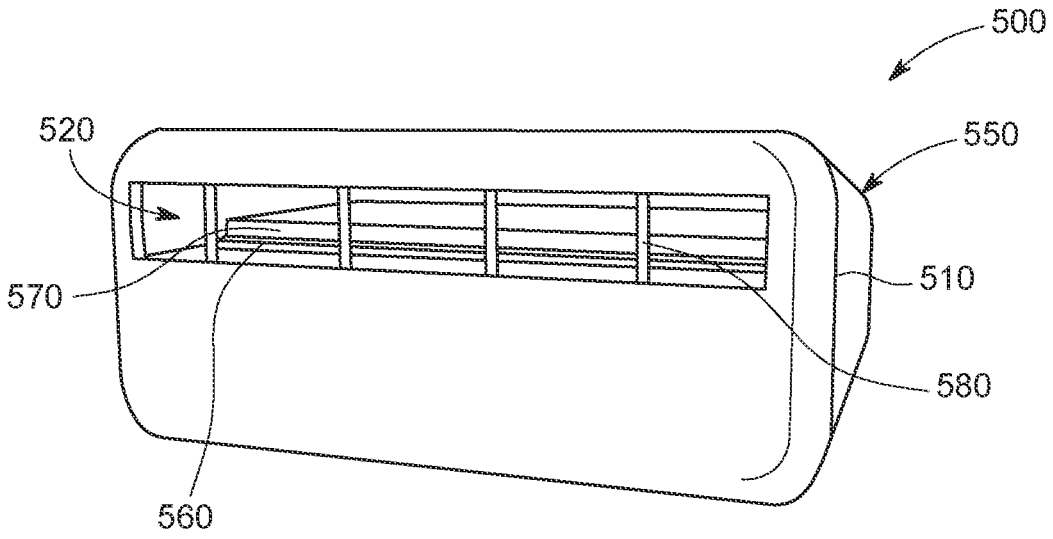
FIG. 5A shows another exemplary embodiment of the air vent assembly for an HVAC unit, according to the present invention.
Figure 5B:
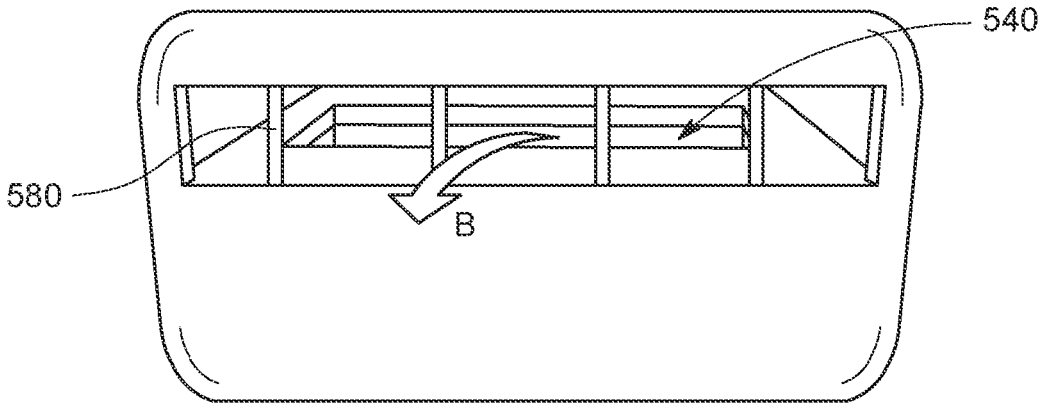
FIG. 5B is a perspective view of a slanted cage of the air vent assembly shown in FIG. 5A showing an opening between an upper chamber and a lower chamber, according to an exemplary embodiment of the present invention.
Figure 5C:
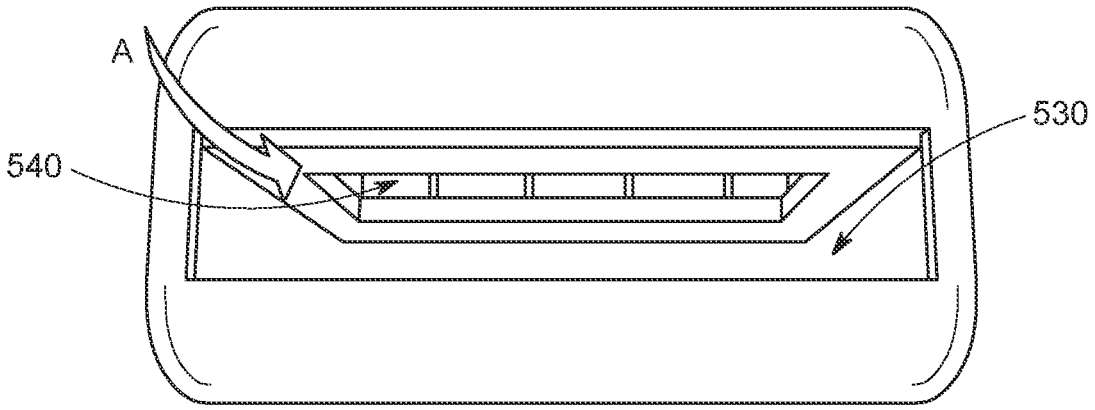
FIG. 5C is a rear view of the slanted cage shown in FIG. 5B, showing an entrance in the lower chamber for air ingress, according to an exemplary embodiment of the present invention.

FIGS. 5A, 5B, and 5C show another exemplary embodiment of the disclosed air vent assembly 500. The air vent assembly 500 can be configured in an outlet of an air conditioning system. The air under pressure from the fan moves the lid 570 upward and the air flows to the grille 580 of the outlet. As shown in FIGS. 5A and 5B, the disclosed air vent assembly 500 includes a cage 510. Cage 510 includes a lower chamber 530 (shown in FIG. 5C) and an upper chamber 520 (shown in FIG. 5A). An aperture 540, more clearly shown in FIGS. 5B and 5C, in a wall dividing the cage 510 into the lower chamber and the upper chamber. The top 550 of the upper chamber 520 can be seen having a slanted geometry. A seat 560 is configured around the aperture 540 in the upper chamber. A lid 570 can be seen placed over the seat, wherein the upper chamber is slanted at the top 550 and limits the lateral movement of the lid. Due to the slope of the top 550, the lid 570 is pushed against the top 550 by the air in an inclined geometry. The lid 570 can move upwards guided by the upper chamber 520. The air blown by a fan flows from the lower chamber 530 (air flow is shown by the arrow A) to the upper chamber 520, causes the lid 570 to move upward and held against the slanted top 550 of the cage. FIG. 5C shows the rear side of the air vent assembly 500 showing an entrance to the lower chamber 530 for air. The air ingress through this entrance in the lower chamber 530 and moves upwards into the upper chamber 520 through the aperture 540. The air in the upper chamber 520 blows outside through the grille 580, shown by arrow B in FIG. 5B. The air vent assembly shown in FIGS. 5A-5C can be used for a vent in horizontal position for providing a unidirectional and self-regulating flow of air. Hot or cold air flows from the lower chamber through an aperture into the upper chamber. The aperture can be closed by a light-weight lid that prevents the reverse flow of air from the upper chamber into the lower chamber. The seat and the lid provide sealing and the sloped cage can regulate the movement of the lid.

Figure 6A:
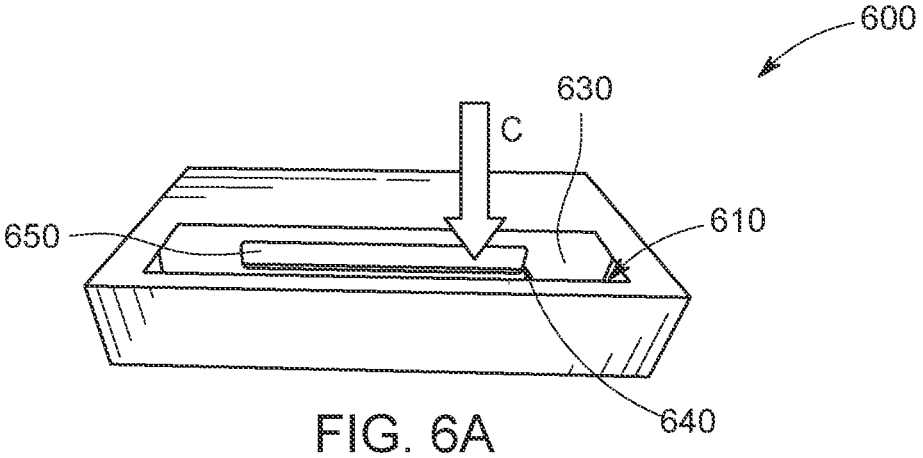
FIG. 6A is a top face of the vent cover having the air vent assembly, according to an exemplary embodiment of the present invention.
Figure 6B:
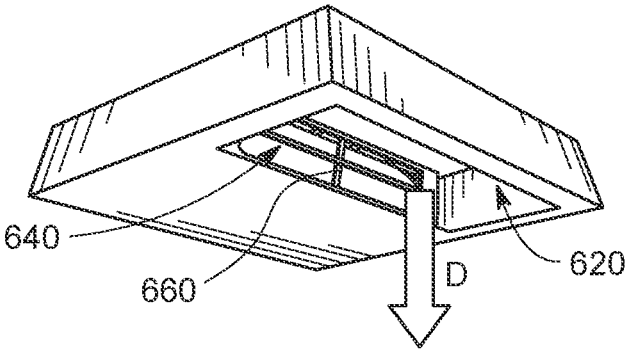
FIG. 6B is a bottom face of the vent cover shown in FIG. 6A, according to an exemplary embodiment of the present invention.
Figure 6C:
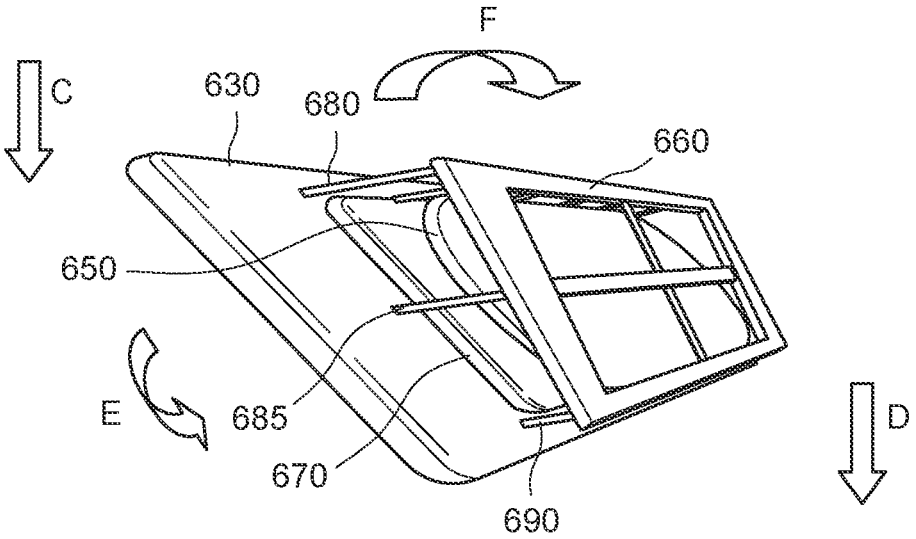
FIG. 6C shows the air vent assembly of the vent cover of FIG. 6A, according to an exemplary embodiment of the present invention.

FIG. 6A-6C shows another exemplary embodiment of the air vent assembly for air condition units in the horizontal application, such as ceiling mounted. FIGS. 6A and 6B shows an air outlet cover 600 of an enclosed body configuration. The air outlet cover 600 having a top face, a bottom face, and upstanding walls between the top face and the bottom face defining an inner volume of the air outlet cover 600. FIG. 6C shows an embodiment of the air vent assembly that is installed in the air outlet cover 600 shown in FIGS. 6A and 6B. The cage of the air vent assembly having a base 630, legs 680, 685, and 690 that extends upwards at an acute angle relative to the base. The legs 680 in the top row of legs are longest and the legs 690 in the lowest row of legs are shortest. The inclination and decreasing heights of the legs give the top 660 a slanted profile.

Referring to FIGS. 6A and 6B, the base of the cage divides the inner volume of the air outlet cover 600 into a right chamber 610 and a left chamber 620. FIG. 6A shows a top face of the air outlet cover 600, while FIG. 6B shows its bottom face. The right chamber 610 is open at the top face, while the bottom chamber 620 is open at the bottom face. The base 630 of the cage, shown in FIG. 6A, is having a passage 640 for air to pass through. FIG. 6A also shows the lid 650 covering the passage 640. The left chamber 620 shown in FIG. 6B is open at the bottom face. Also, can be seen in FIG. 6B is the cage. The seat 670 can be configured around the opening 640 of the base 630 in the left chamber 620. The top 660 of the cage including the cross splines can also be seen in the left chamber 630. The base 630 is mounted in the air outlet cover 600 at an acute angle relative to the right chamber, as shown in FIG. 6C. The long legs 680 can be adjacent to the top face of the air outlet cover 600. Circulation of air is shown by arrows C to F. Arrow C in FIGS. 6A and 6C shows the flow of air into the right chamber 610. Arrow D in FIGS. 6B and 6C shows the flow of air from the left chamber 620 downwards. The air in the right chamber 610 enters through the passage 640 into the left chamber 620, shown by arrow E in FIG. 6C. The air causes the lid 650 to be pushed towards the slanted top 660 of the cage opening the passage 640 for air. The air from the passage 640 can flow out in a direction shown by the arrow F into the left chamber 620 and into then into the dwelling unit. When no air is flowing from the right chamber 610 to the left chamber 620, but the air tends to flow in the reverse direction, the lid is pushed over the seat, resulting in blocking of the passage, thus reverse flow of air from the left chamber into the right chamber is blocked.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An air vent assembly comprising:

a seat having a passage for air;

a lid of a size commensurate with a size of the seat, the lid is configured to be placed on the seat blocking the passage;

a cage configured around the lid and the seat, the cage having an upstanding member and a slanted top, the cage limits sideward movement of the lid and provides a guided upward movement for an entirety of the lid relative to the seat, the cage having a proximal end and a distal end, a height of the cage ascends from the proximal end to the distal end resulting in the slanted top, wherein the lid when held against the slanted top of the cage is inclined at an angle that is commensurate with an angle of the slanted top of the cage.

2. The air vent assembly according to claim 1, wherein the cage further comprises a base, the base has an opening of a size that corresponds to a size of the passage of the seat, the seat is attached around the opening of the base, wherein the upstanding member extends between the slanted top and the base.

3. The air vent assembly according to claim 2, wherein the upstanding member comprises at least three legs spaced apart, at least one leg of the at least three legs is longest, the at least one longest leg is adjacent to the distal end of the cage.

4. The air vent assembly according to claim 3, wherein a difference between heights of the at least one longest leg and at least one shortest leg of the at least three legs is proportional to the angle of the slated top.

5. The air vent assembly according to claim 4, wherein heights of the at least one longest leg and the at least one shortest leg are of proportion 2:0.75.

6. The air vent assembly according to claim 2, wherein the base is configured to cover a vent in a ceiling of a dwelling unit.

7. The air vent assembly according to claim 2, wherein the upstanding member is coupled to a periphery of the base.

8. The air vent assembly according to claim 1, wherein the seat is made of soft rubber.

9. The air vent assembly according to claim 8, wherein the lid is made of aluminum.

10. The air vent assembly according to claim 1, wherein the upstanding member is a hollow cylinder having a sloped upper end, a flange extends perpendicular around an inner periphery of a lower end of the hollow cylinder, the flange has an aperture with a size that corresponds to the size of the passage of the seat, the slanted top of the cage has a pair of cross-splines coupled to the sloped upper end of the hollow cylinder.

11. An air vent cover for a vent in a ceiling of a dwelling unit, the vent connected to a duct or pipe of a ventilation system, the air vent cover comprising:

a panel configured to cover the vent, the panel having one or more apertures; and one or more air vent assemblies, wherein each air vent assembly of the one or more air vent assemblies fits into a respective aperture of the one or more apertures in the panel, each air vent assembly comprises:

a cage comprising:

a base member having an aperture, an upstanding hollow cylinder having an upper end and a lower end, the lower end is integral to a periphery of the base member, the upper end is sloped, a pair of cross splines extend between a periphery of the sloped upper end forming a slanted top, a seat attached to an upper surface of the base member within the cage, the seat having a passage for air, a size of the passage corresponds to a size of the aperture in the base member, and a lid of a size commensurate with the size of the seat, the lid is placed on the seat blocking the passage, lateral movement of the lid is restricted by the hollow cylinder, the lid is configured to move upwards within the cage resulting in opening of the passage, the lid is configured to be pushed against the slanted top in an inclined position.

12. The air vent cover according to claim 11, wherein the one or more apertures of the panel comprises four apertures, the one or more air vent assemblies comprises four air vent assemblies, and each air vent assembly fits into a respective aperture in the panel.

13. The air vent assembly according to claim 11, wherein the air vent cover further comprises a fastener for coupling the lid with the seat.

14. An air vent assembly comprising:

a cage;

a wall dividing the cage into an upper chamber and a lower chamber, the wall having an opening for air, the upper chamber having an outlet for the air, the lower chamber having an inlet for the air;

a seat configured around the opening in the wall, the seat having a passage for the air;

a lid configured to be placed on the seat blocking the passage, wherein the upper chamber has a slanted top, the upper chamber limits sideward movement of the lid and provides a guided upward movement for an entirety of the lid relative to the seat, wherein the lid when held against the slanted top is inclined at an angle that is commensurate with an angle of the slanted top.

* * * * *